US007225875B2

(12) United States Patent
Steele et al.

(10) Patent No.: US 7,225,875 B2
(45) Date of Patent: Jun. 5, 2007

(54) MULTI-LAYERED WELLBORE JUNCTION

(75) Inventors: David J. Steele, Irving, TX (US); John M. Kolker, Farmers Branch, TX (US); Hendrik M. Stoltz, Edmonton (CA); Gerald E. Kent, Spruce Grove (CA)

(73) Assignee: Halliburton Energy Services, Inc., Houston, TX (US)

( * ) Notice: Subject to any disclaimer, the term of this patent is extended or adjusted under 35 U.S.C. 154(b) by 214 days.

(21) Appl. No.: 10/773,899

(22) Filed: Feb. 6, 2004

(65) Prior Publication Data

US 2005/0173121 A1 Aug. 11, 2005

(51) Int. Cl.
*E21B 43/14* (2006.01)
*E21B 33/13* (2006.01)

(52) U.S. Cl. ..... 166/313; 166/50; 166/187; 166/381; 166/242.1

(58) Field of Classification Search ..... 166/50, 166/381, 207, 242.1, 242.2, 242.3, 313, 187; 138/93, 97, 98, 89, 148; 137/15.15; 405/150.1
See application file for complete search history.

(56) References Cited

U.S. PATENT DOCUMENTS

| | | | | |
|---|---|---|---|---|
| 2,314,540 | A * | 3/1943 | Huntington | 73/149 |
| 4,982,625 | A * | 1/1991 | Bonner | 81/53.2 |
| 5,141,051 | A | 8/1992 | Lenhart | |
| 5,318,122 | A | 6/1994 | Murray et al. | |
| 5,329,063 | A * | 7/1994 | Endoh | 138/98 |
| 5,330,007 | A | 7/1994 | Collins et al. | |
| 5,337,823 | A | 8/1994 | Nobileau | |
| 5,340,626 | A | 8/1994 | Head | |
| 5,350,481 | A * | 9/1994 | Shepard et al. | 156/423 |
| 5,358,418 | A | 10/1994 | Carmichael | |
| 5,388,648 | A | 2/1995 | Jordan, Jr. | |
| 5,395,472 | A * | 3/1995 | Mandich | 156/287 |
| 5,425,559 | A | 6/1995 | Nobileau | |
| 5,479,986 | A | 1/1996 | Gano et al. | |
| 5,613,557 | A * | 3/1997 | Blount et al. | 166/277 |
| 5,655,602 | A | 8/1997 | Collins | |
| 5,695,008 | A | 12/1997 | Bertet et al. | |
| 5,718,288 | A | 2/1998 | Bertet et al. | |
| 5,794,702 | A | 8/1998 | Nobileau | |
| 5,817,737 | A | 10/1998 | Mariaggi et al. | |
| 5,823,257 | A | 10/1998 | Peyton | |
| 5,964,288 | A | 10/1999 | Leighton | |
| 5,979,560 | A | 11/1999 | Nobileau | |

(Continued)

FOREIGN PATENT DOCUMENTS

| | | |
|---|---|---|
| GB | 2275286 | 8/1994 |

(Continued)

OTHER PUBLICATIONS

U.S. Appl. No. 10/121,471, filed Apr. 11, 2002.

(Continued)

*Primary Examiner*—Kenneth Thompson
(74) *Attorney, Agent, or Firm*—Marlin R. Smith

(57) ABSTRACT

A multi-layered wellbore junction. In a described embodiment, a method of forming an expanded chamber in a subterranean well includes the steps of: positioning multiple chamber sidewall layers in the well; and expanding the layers in the well to form the expanded chamber.

56 Claims, 8 Drawing Sheets

U.S. PATENT DOCUMENTS

| | | | | |
|---|---|---|---|---|
| 6,026,903 | A | 2/2000 | Shy et al. | |
| 6,056,059 | A | 5/2000 | Ohmer | |
| 6,089,320 | A | 7/2000 | LaGrange | |
| 6,189,616 | B1 | 2/2001 | Gano et al. | |
| 6,252,852 | B1 | 6/2001 | Rowles et al. | |
| 6,253,846 | B1 | 7/2001 | Nazzai | |
| 6,253,850 | B1 * | 7/2001 | Nazzai et al. | 166/277 |
| 6,253,852 | B1 | 7/2001 | Nobileau | |
| 6,283,209 | B1 * | 9/2001 | Keller | 166/264 |
| 6,315,040 | B1 | 11/2001 | Donnelly | |
| 6,336,507 | B1 * | 1/2002 | Collins | 166/313 |
| 6,401,815 | B1 * | 6/2002 | Surjaatmadja et al. | 166/277 |
| 6,439,932 | B1 | 8/2002 | Ripolone | |
| 6,564,867 | B2 | 5/2003 | Ohmer | |
| 6,648,075 | B2 * | 11/2003 | Badrak et al. | 166/381 |
| 6,703,095 | B2 * | 3/2004 | Busshoff et al. | 428/36.91 |
| 2002/0033261 | A1 | 3/2002 | Metcalfe | |
| 2005/0087345 | A1 | 4/2005 | Steele | |

FOREIGN PATENT DOCUMENTS

| | | |
|---|---|---|
| GB | 2353811 | 3/2001 |
| GB | 2395210 | 5/2004 |
| GB | 2397600 | 7/2004 |
| WO | WO 9425655 A1 * | 11/1994 |
| WO | WO 98/09054 | 3/1998 |
| WO | WO 99/13195 | 3/1999 |
| WO | WO 00/26501 | 5/2000 |
| WO | WO 00/50733 | 8/2000 |
| WO | WO 02/29207 | 4/2002 |
| WO | WO 02/29208 | 4/2002 |

OTHER PUBLICATIONS

U.S. Appl. No. 10/348,212, filed Jan. 21, 2003.
Web page: www.pml.tno.nl:80/en/em/ap-welding.html, "Explosive Welding and Cladding of Metals", undated.
Web page: http://www.mdacomposites.org/materials.htm, "FRP Composite Materials: An Overview", undated.
Web page: http://www.engr.siu.edu/staff2/abrate/rtm/relate.htm, Southern Illinois University, RTM Related Processes, dated 2000.
Web page: http://www.highenergymetals.com/, High Energy Metals, Inc. "Explosive Metalworking Experts", dated 2000.
Web page: http://www.highenergymetals.com/Engineering%20and%20Design%20Basics%20Web%20Page.pdf, High Energy Metals, Inc., "Explosion Bonding Engineering and Design Basics", dated Mar. 8, 2000.
Office Action for U.S. Appl. No. 10/348,212 dated Apr. 16, 2004.
Search Report for United Kingdom application No. GB0401224.1.
Office Action for U.S. Appl. No. 10/997,619 dated Sep. 14, 2005.
Search Report for United Kingdom application No. GB0502350.2.
Cameron Controls, "Advanced Electro-Hydraulic Multiplexed Production Control System", undated.
Hermetic Seal Corporation brochure, "High Temperature High Pressure Electrical Bulkhead Connectors", 1 pg.
Wireline Technologies Incorporated brochure, 1.50" Dia. Flowthru Wet-Connect and 1.50" Dia. Standard Wet-Connect, 2 pgs.
Schlumberger, "WCF Wet Connect Firing Systems", 2 pgs., 2004.
AnTech, "Coiled Tubing Downhole Tools", 4 pgs., 2001.
U.S. Appl. No. 10/121,471, filed Apr. 11, 2002, entitled Expandable Float Shoe and Associated Methods.
Examination Report for United Kingdon application no. GB0502350.2 dated Oct. 4, 2006.

* cited by examiner

MULTI-LAYERED WELLBORE JUNCTION

BACKGROUND

The present invention relates generally to equipment utilized and operations performed in conjunction with a subterranean well and, in an embodiment described herein, more particularly provides a multi-layered wellbore junction.

Significant difficulties have been experienced in the art of forming expanded chambers within a well. For example, a wellbore junction constructed out of welded-together single layer metal sheets at the surface may be collapsed (laterally compressed) at the surface prior to running it into a well. The junction may then be reformed (expanded) to its approximate uncompressed configuration in the well.

Unfortunately, the expanded junction may not have sufficient burst and collapse pressure ratings due to several factors. One of these factors may be work hardening of the metal material when it is collapsed at the surface and then expanded downhole. Another factor may be imperfect reforming of the junction to its original shape.

Therefore, it may be seen that improved methods of expanding wellbore junctions and improved wellbore junction configurations are needed. Such methods and configurations may be used in other applications as well. For example, an expanded chamber in a well may be useful for other purposes, such as oil/water separation, downhole manufacturing, etc.

SUMMARY

In carrying out the principles of the present invention, in accordance with an embodiment thereof, an expandable wellbore junction is provided which solves at least some of the above problems in the art.

In one aspect of the invention, a subterranean well system is provided which includes a chamber expanded within the well. The chamber has a sidewall made up of multiple layers.

In another aspect of the invention, a method of forming an expanded chamber in a subterranean well is provided. The method includes the steps of: positioning multiple chamber sidewall layers in the well; and expanding the layers in the well to form the expanded chamber.

In yet another aspect of the invention, a wellbore junction for use in a subterranean well is provided. The wellbore junction includes a sidewall made up of multiple layers expanded in the well. In still another aspect of the invention, the wellbore junction includes a sidewall made of a single layer of composite material.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1A:
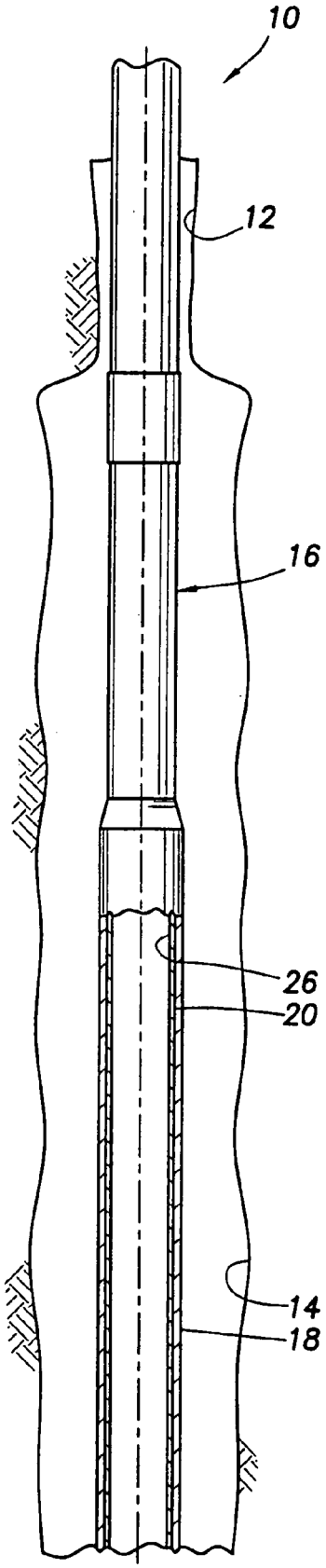
FIGS. 1A–C are partially cross-sectional views of successive axial sections of a subterranean well system embodying principles of the present invention.
Figure 1B:
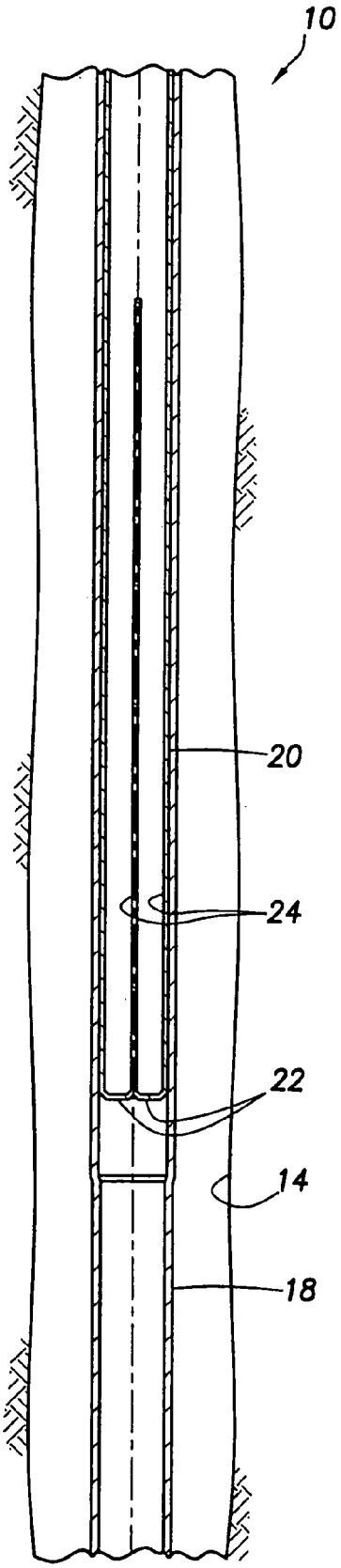
Figure 1C:
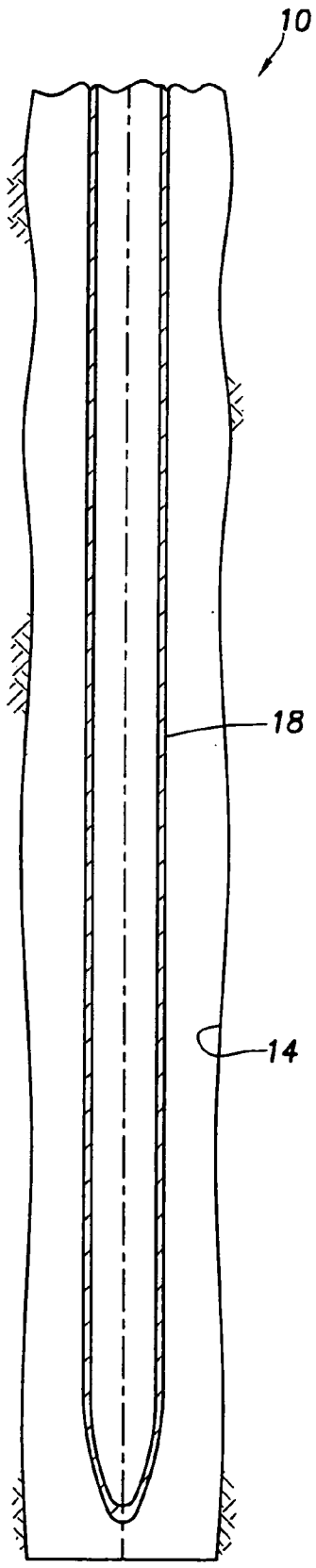

Representatively illustrated in FIGS. 1A–C is a subterranean well system 10 which embodies principles of the present invention. In the following description of the system 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

As depicted in FIGS. 1A–C, a wellbore 12 has been drilled, and then underreamed to form an enlarged cavity 14. A tubular string 16, such as a casing, liner or tubing string, is conveyed into the wellbore 12. At a lower end of the tubular string 16, a generally tubular outer shell 18 in an unexpanded configuration is positioned in the underreamed cavity 14.

The outer shell 18 may at this point be collapsed or compressed from an initial expanded configuration at the surface. Alternatively, the outer shell 18 may be initially constructed in the unexpanded configuration.

The outer shell 18 may be made of any type of material. Preferably, the outer shell 18 is made of metal or a composite material. In addition, the outer shell 18 is preferably capable of holding pressure, so that it can be expanded by increasing a pressure differential from its interior to its exterior (e.g., by applying increased pressure to its interior). However, it should be clearly understood that any method of expanding the outer shell 18 may be used in keeping with the principles of the invention. For example, the outer shell 18 could be expanded by mechanically swaging it outward, drifting, etc.

An inner shell 20 is positioned within the tubular string 16. The inner shell 20 may be conveyed into the wellbore 12 at the same time as the outer shell 18, or it may be conveyed into the wellbore after the outer shell. For example, the inner shell 20 could be conveyed through the tubular string 16 after the outer shell 18 is expanded in the wellbore 12.

The inner shell 20 is constructed with two generally tubular legs 22 at its lower end, since the system 10 in this embodiment is used for constructing a wellbore junction downhole. Thus, the inner shell 20 has an inverted somewhat Y-shaped configuration with two wellbore exits 24 at its lower end and a single interior passage 26 and tubular string connection 27 at its upper end. However, the inner shell 20 could have any number of wellbore exits 24, and the inner shell could be otherwise configured, in keeping with the principles of the invention. For example, the inner shell 20 could be shaped similar to the outer shell 18, or with no wellbore exits, etc.

As with the outer shell 18, the inner shell 20 could be made of any type of material, but is preferably made of metal or a composite material. The inner shell 20 is preferably capable of holding pressure, so that it may be expanded by inflating it, but any expanding method may be used as an alternative to inflation, such as mechanical swaging, drifting, etc. The inner shell 20 could be mechanically swaged, drifted, etc. after it is expanded by inflating, for example, to ensure that its legs 22 and wellbore exits 24 have a desired shape, such as a cylindrical shape, for improved sealing thereto and/or for improved access therethrough.

Furthermore, the inner shell 20 in its unexpanded configuration as depicted in FIGS. 1A–C may be collapsed or compressed from an initial expanded configuration, or it may be initially formed in its unexpanded configuration.

Figure 2A:
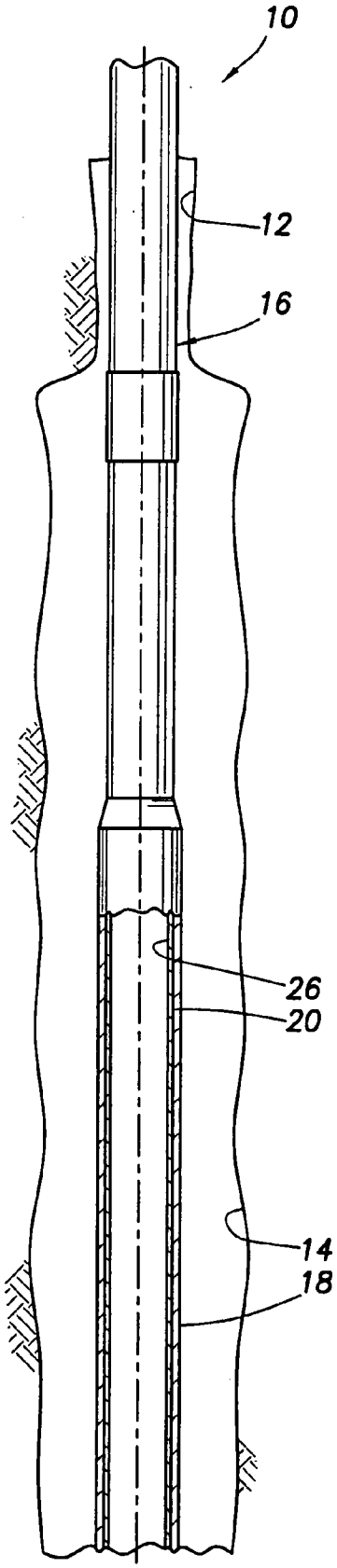
FIGS. 2A–C are partially cross-sectional views of the well system of FIG. 1, wherein an outer shell of a wellbore junction has been expanded.
Figure 2B:
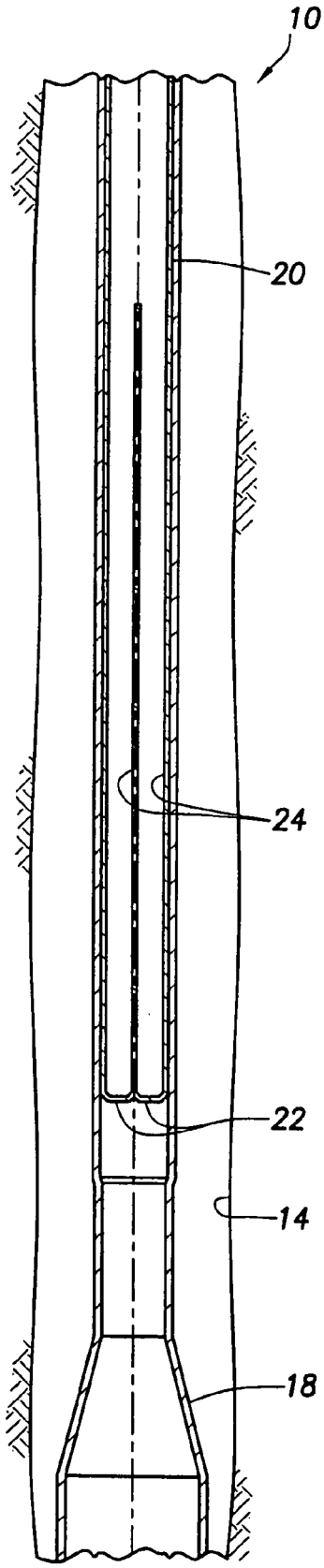
Figure 2C:
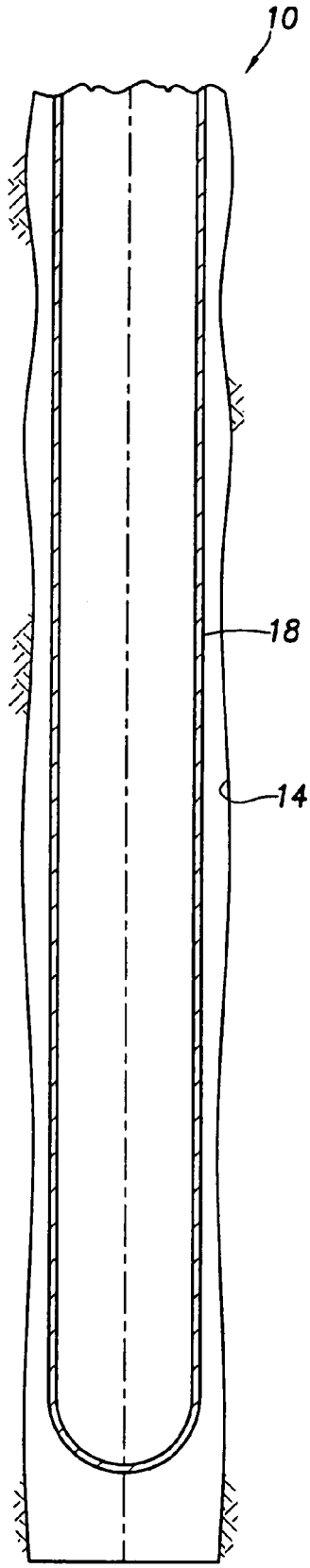

Referring additionally now to FIGS. 2A–C, the system 10 is representatively illustrated after the outer shell 18 has been expanded in the cavity 14. As described above, this expansion is preferably accomplished by inflating the outer shell 18. Note that the inner shell 20 remains in the tubular string 16 above the outer shell 18 while the outer shell is expanded. However, the inner shell 20 could be positioned in the outer shell 18 before, during and/or after the outer shell is expanded.

Figure 3A:
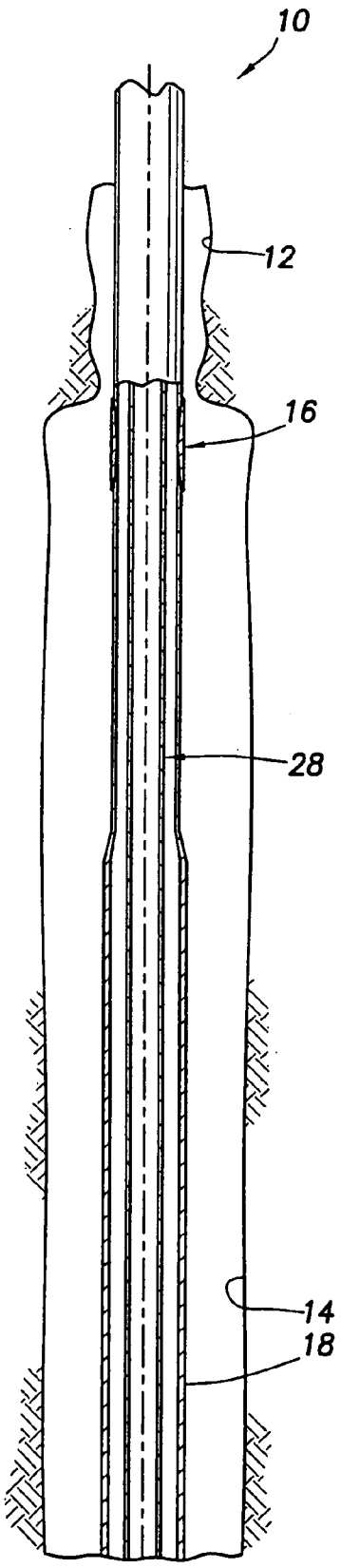
FIGS. 3A–C are partially cross-sectional views of the well system of FIG. 1, wherein an inner shell of the wellbore junction has been displaced into the expanded outer shell.
Figure 3B:
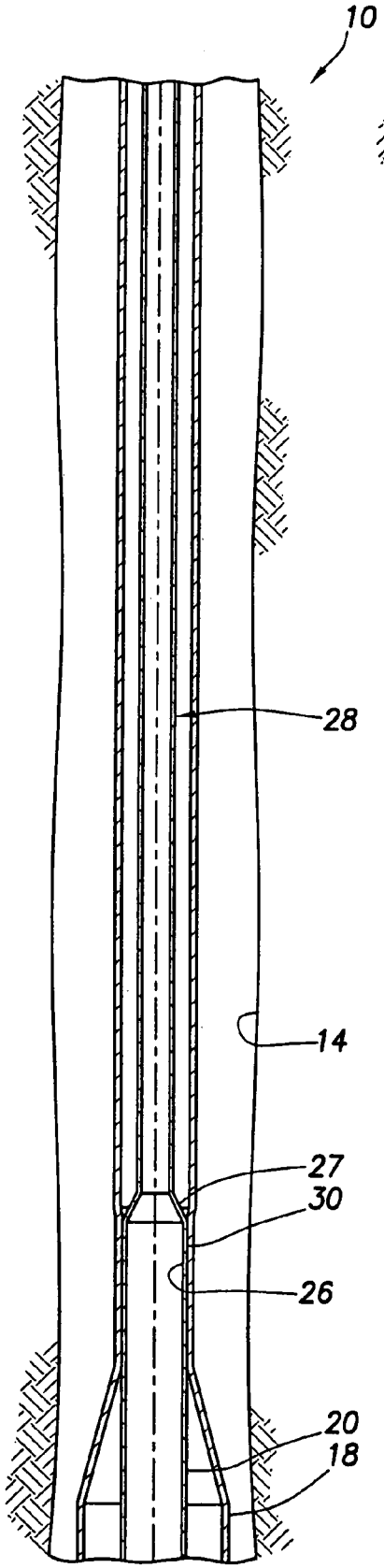
Figure 3C:
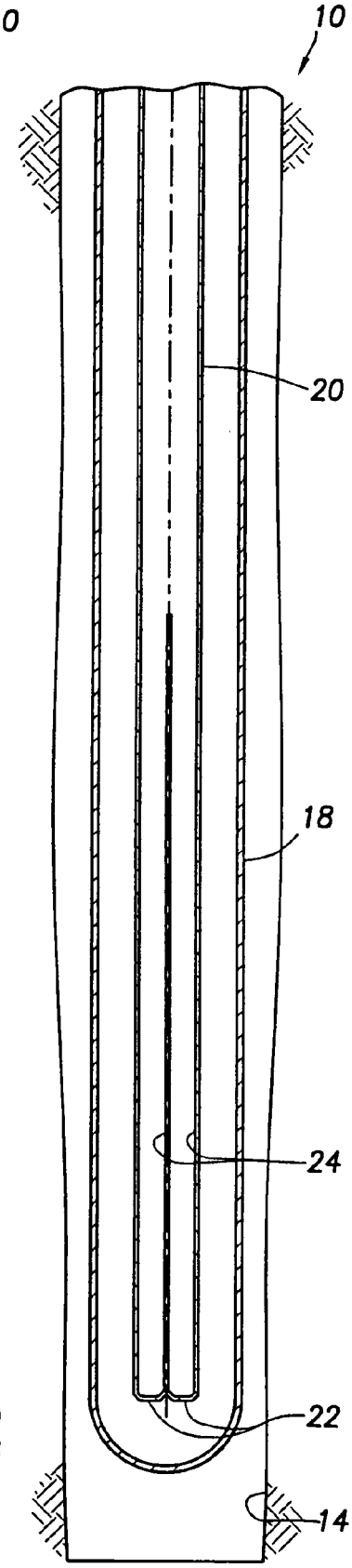

Referring additionally now to FIGS. 3A–C, the system 10 is representatively illustrated after the inner shell 20 has been displaced into the outer shell 18. Preferably, the inner shell 20 is suspended from another tubular string 28 within the tubular string 16, in which case the inner shell may be conveniently displaced into the outer shell 18 by lowering the inner tubular string 28 from the surface. However, it should be understood that any method of displacing the inner shell 20 into the outer shell 18 may be used in keeping with the principles of the invention.

A seal 30 may be formed between the inner and outer shells 18, 20 when the inner shell 20 is displaced into the outer shell 18. The seal 30 may be a metal-to-metal seal formed by contact between the inner and outer shells 18, 20, or any other type of seal may be used, such as elastomer seals, non-elastomer seals, etc.

Figure 4A:
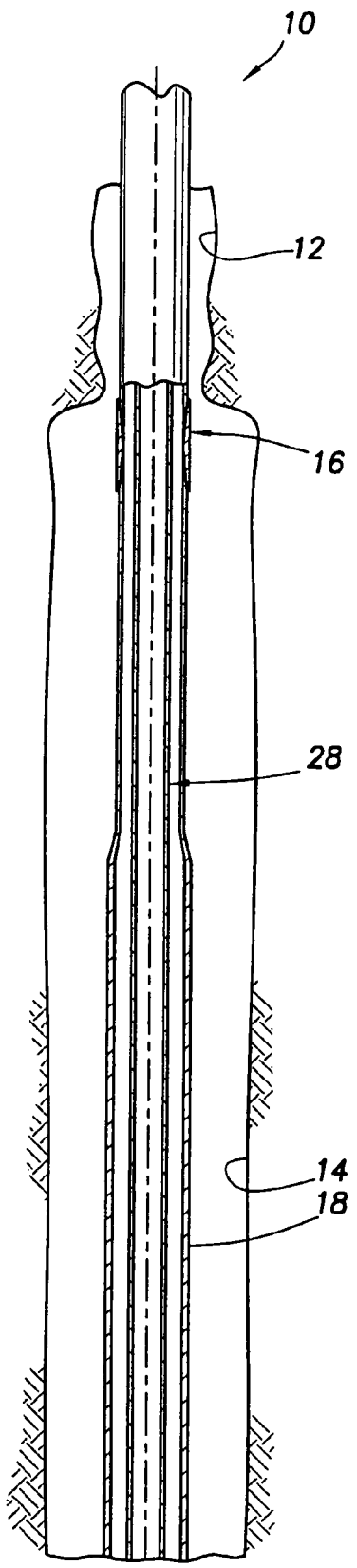
FIGS. 4A–C are partially cross-sectional views of the well system of FIG. 1, wherein the inner shell has been expanded.
Figure 4B:
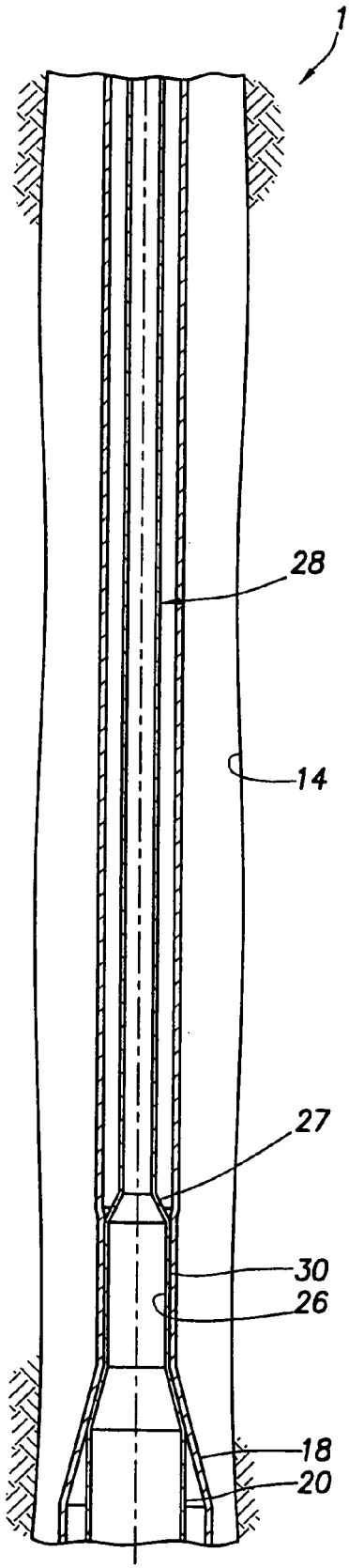
Figure 4C:
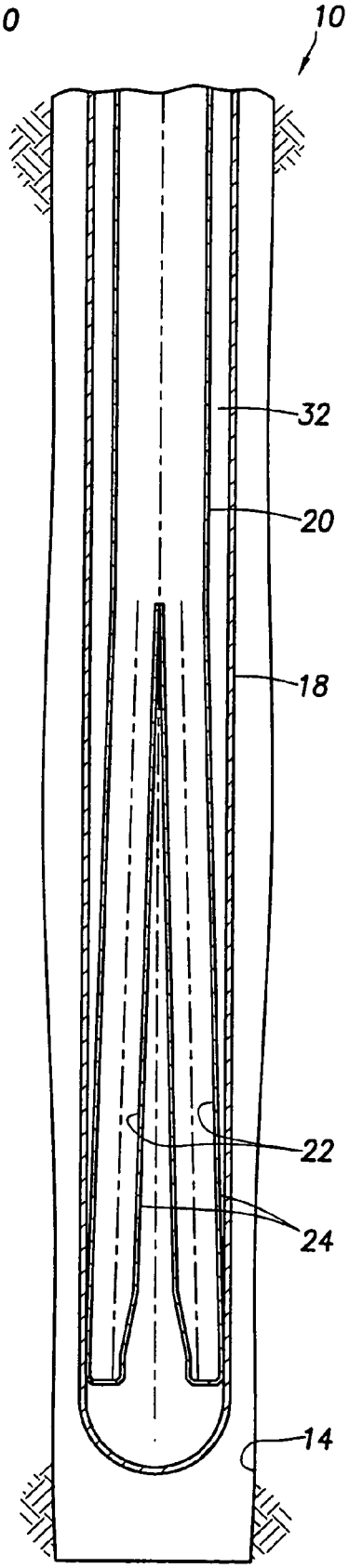

Referring additionally now to FIGS. 4A–C, the system 10 is representatively illustrated after the inner shell 20 has been expanded within the outer shell 18. As described above, the inner shell 20 may be expanded by inflating, or by any other method. Note that the legs 24 now diverge somewhat from each other, so that additional wellbores (not shown) drilled from the wellbore exits 22 will be directed away from each other. In addition, note that although the inner shell 20 has been expanded within the outer shell 18, there remains a space 32 between the inner and outer shells.

Figure 5A:
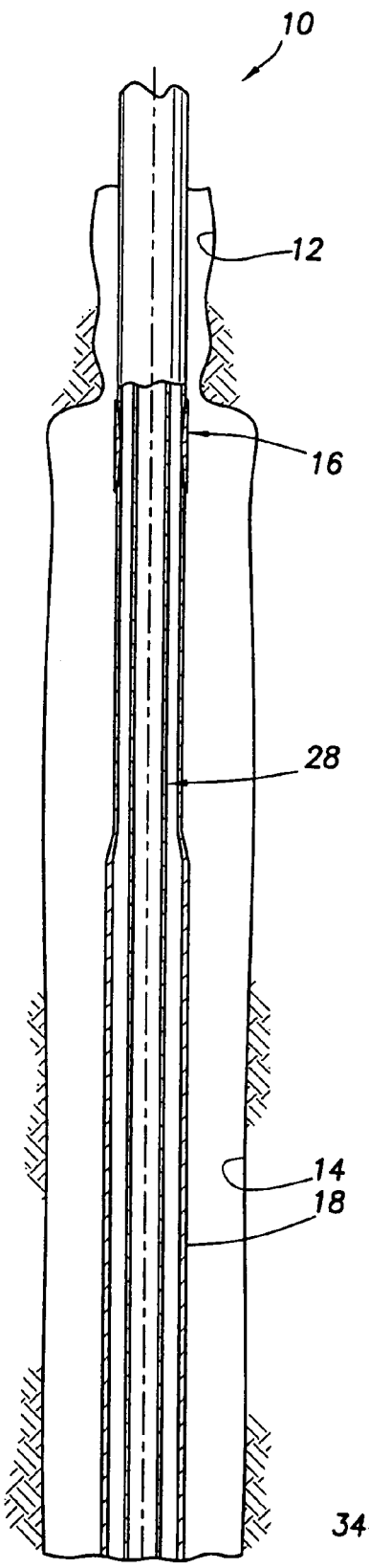
FIGS. 5A–C are partially cross-sectional views of the well system of FIG. 1, wherein a load bearing material has been positioned between the expanded inner and outer shells.
Figure 5B:
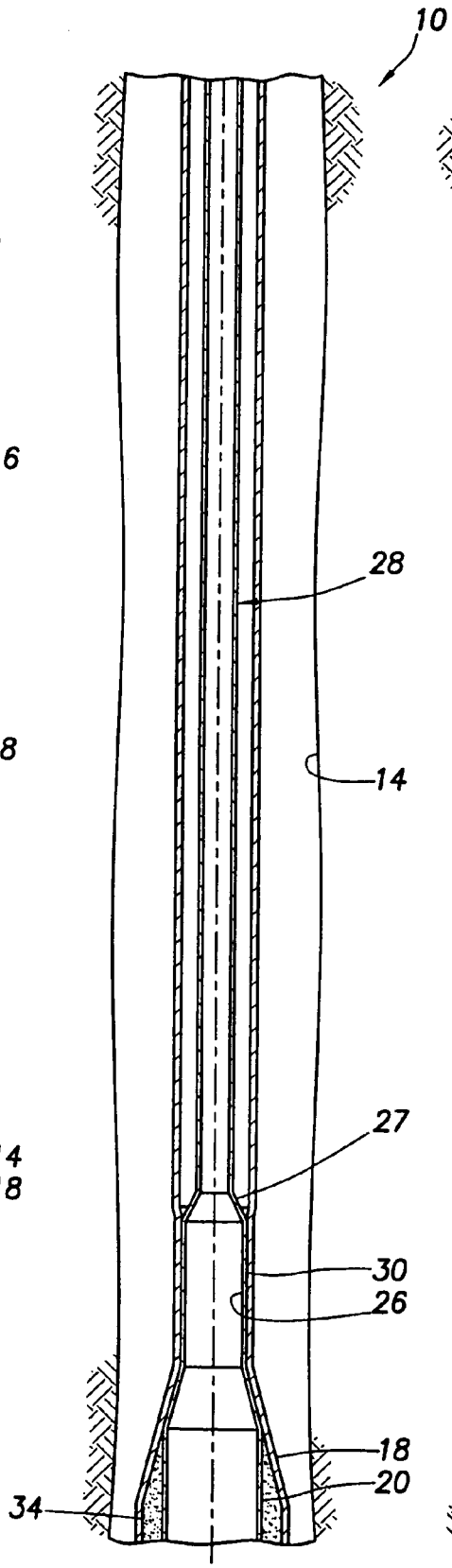
Figure 5C:
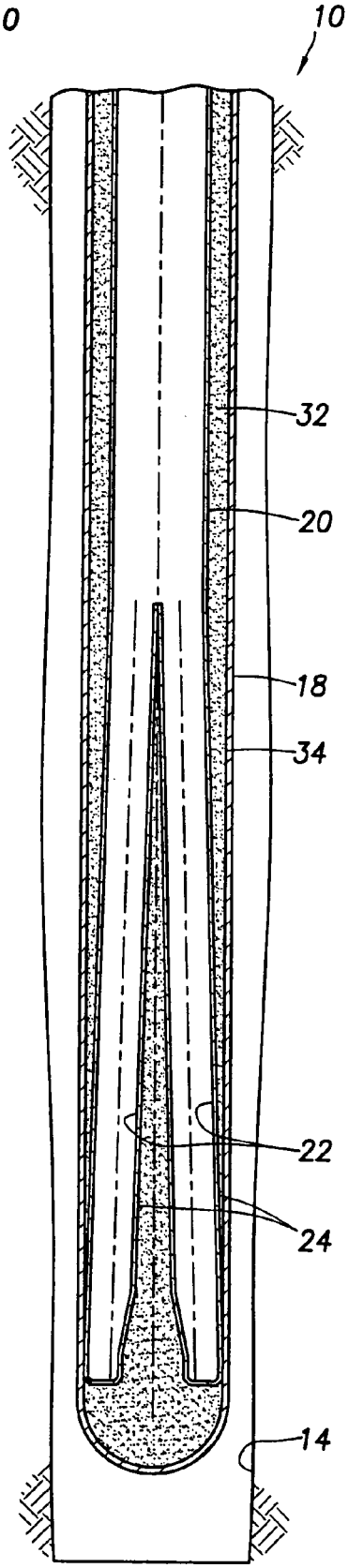

Referring additionally now to FIGS. 5A–C, the system 10 is representatively illustrated after a load bearing material 34 has been positioned in the space 32 between the inner and outer shells 18, 20. Preferably, the load bearing material 34 is initially in a liquid state and is pumped into the space 32 while it is liquid. Eventually, the material 34 solidifies and forms a load bearing support for the inner and outer shells 18, 20. The seal 30 prevents the material 34 from flowing into the interior of the tubular string 16 above the outer shell 18.

Note that the material 34 may be positioned in the outer shell 18 before or after displacing the inner shell 20 into the outer shell. Furthermore, the material 34 could be positioned in the space 32 before or after the inner shell 20 is expanded within the outer shell 18. The material 34 could be positioned within the outer shell 18 before or after the outer shell is expanded, and additional material could be added within the outer shell while it is being expanded (e.g., the outer shell could be inflated while the material is pumped into the outer shell). Thus, the order of the steps described herein may be varied, without departing from the principles of the invention.

In one method, the load bearing material 34 could be positioned within the outer shell 18 when it is initially run into the well. Later, when it is desired to inflate the outer shell 18, additional material 34 could be positioned within the outer shell.

Figure 6A:
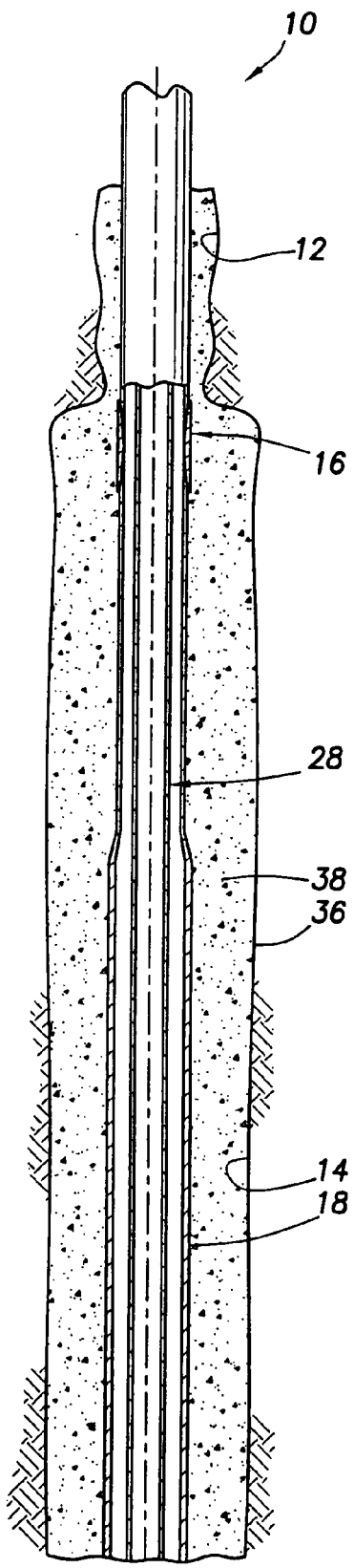
FIGS. 6A–C are partially cross-sectional views of the well system of FIG. 1, wherein the wellbore junction has been cemented in a wellbore.
Figure 6B:
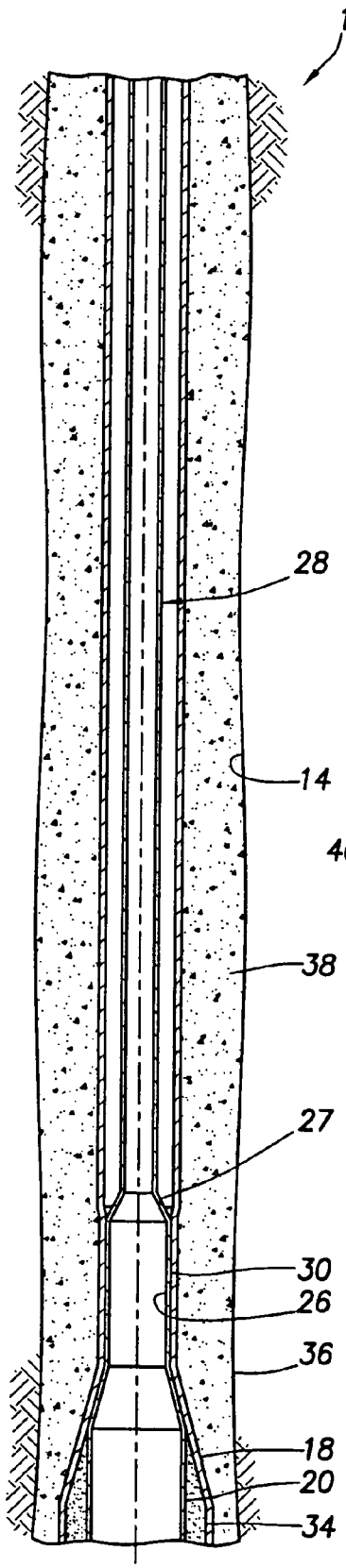
Figure 6C:
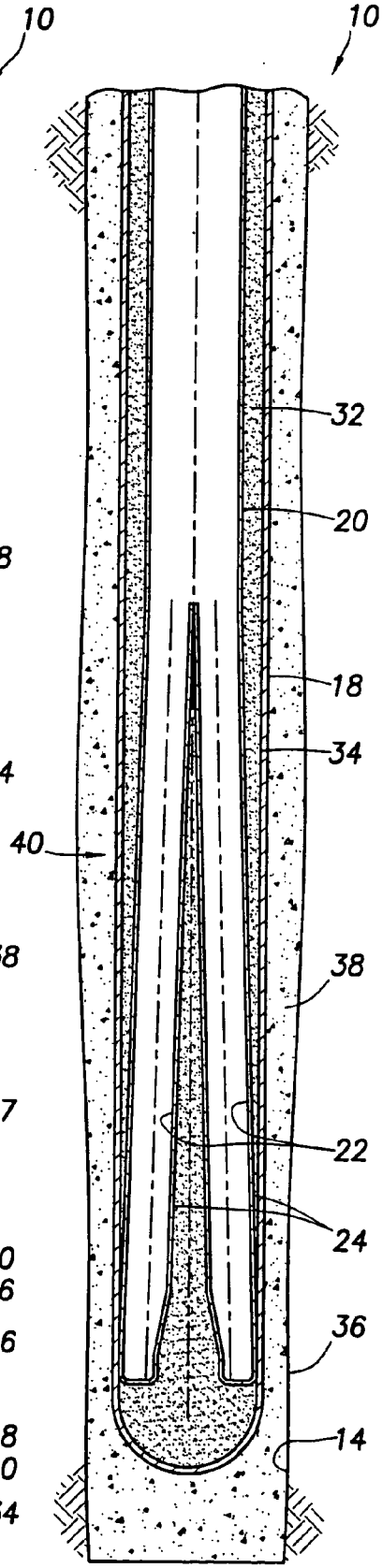

Referring additionally now to FIGS. 6A–C, the system 10 is representatively illustrated after the tubular string 16 and expanded inner and outer shells 18, 20 have been cemented in the wellbore 12. To displace cement 36 into an annulus 38 between the wellbore 12, and the tubular string 16 and the expanded outer shell 18, a drill (not shown) may be used to drill an opening through a lower end of one of the legs 24, through the material 34, and through the outer shell. The cement 36 may then be flowed downward through the tubular string 28 and outward through the drilled opening into the annulus 38. Preferably, a tubular work string or cementing string (not shown) would be lowered through the tubular string 28 and sealed in the one of the legs 24 having the opening drilled through its lower end, in order to flow the cement 36 out into the annulus 38.

It may now be appreciated that a chamber in the shape of a wellbore junction 40 has been formed by the inner and outer shells 18, 20, and the load bearing material 34 between the shells. The wellbore junction 40 has been cemented in the wellbore 12 (in the underreamed cavity 14), and additional wellbores can now be drilled by conveying drills, etc. through the wellbore exits 22.

However, it should be clearly understood that the wellbore junction 40 is only one example of a variety of chambers, vessels, etc. that may be constructed downhole using the principles of the invention. For example, a chamber could be constructed downhole which does not have the two legs 22 or wellbore exits 24 at a lower end thereof. Instead, the chamber could be sized and shaped to house an oil/water separator, or a downhole factory, etc.

Figure 7:
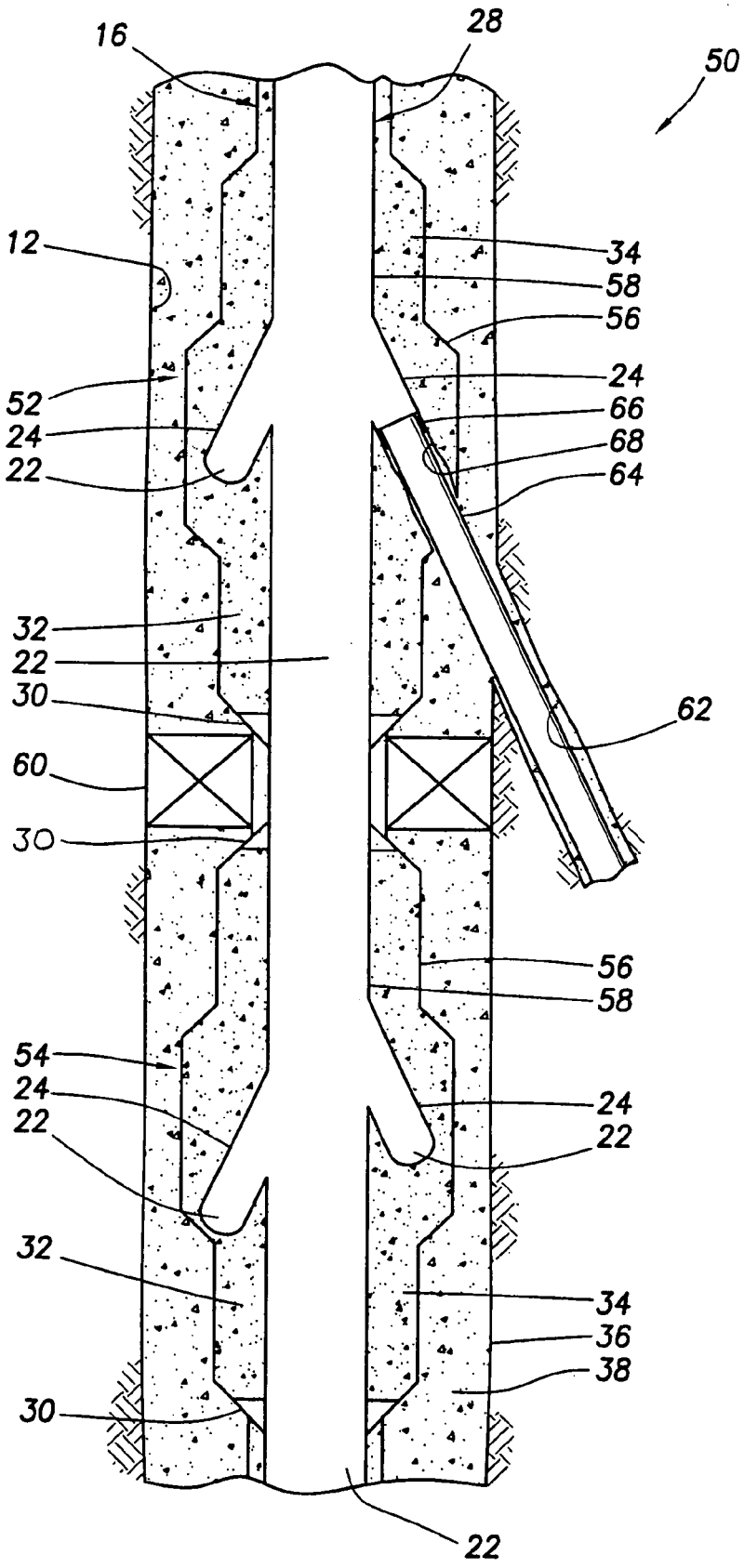
FIG. 7 is a schematic cross-sectional view of another well system embodying principles of the invention.

Referring additionally now to FIG. 7, another system 50 embodying principles of the invention is schematically and representatively illustrated. The system 50 is similar in many respects to the system 10 described above, and so elements depicted in FIG. 7 which are similar to those described above are indicated using the same reference numbers.

One substantial difference between the systems 10, 50 is that, in the system 50, multiple wellbore junctions 52, 54 are formed downhole. Specifically, the outer tubular string 16 has multiple outer shells 56 connected at a lower end thereof, and the inner tubular string 28 has a corresponding number of inner shells 58 connected at a lower end thereof. Only two wellbore junctions 52, 54 are depicted in FIG. 7, but any number of wellbore junctions may be formed in keeping with the principles of the invention.

A packer 60 (or other type of annular barrier) is used to seal off the annulus 38 between adjacent pairs of the outer shells 56, and to secure the wellbore junctions 52, 54 in the wellbore 12. Note that the wellbore 12 is not underreamed in the system 50, but it could be underreamed, if desired. In addition, use of the packer 60 is not necessary. For example, if it is desired to cement the junctions 52, 54 in the wellbore 12 at the same time, or for some other reason isolation of the wellbore between the junctions is not required, the packer 60 may not be used.

It may be convenient to form the wellbore junctions 52, 54 separately or simultaneously. For example, the outer shells 56 could be expanded at the same time, or they could be separately expanded. The inner shells 58 could be displaced into the expanded outer shells 56 at the same time, or they could be separately displaced (for example, one inner shell 58 could be displaced while the other inner shell remains stationary). The inner shells 58 could be expanded at the same time, or they could be separately expanded. The material 34 could be positioned in the wellbore junctions 52, 54 at the same time, or it could be positioned in the wellbore junctions separately.

Note that the wellbore junction 54 has a seal 30 between the inner and outer shells 56, 58 both at the upper and lower ends of the junction. The seals 30 may be used to contain the material 34 between the inner and outer shells 56, 58 of the junction 54 when the material is separately positioned in the junctions 52, 54. The seals 30 between the junctions 52, 54 may not be needed if the material is to be positioned simultaneously in each of the junctions. However, if the junctions 52, 54 are separated by hundreds or thousands of feet in the wellbore, the seals 30 between the junctions can be used to reduce the amount of load bearing material 34 required (i.e., it may not be necessary to use the material between the seals).

Another difference between the systems 10, 50 is that each of the wellbore junctions 52, 54 in the system 50 has three exits 22 at its lower end. One of the exits 22 in each of the wellbore junctions 52, 54 is preferably generally inline with the wellbore 12 and permits access to, and fluid communication with, the wellbore 12 below the junction. The other two exits 22 are used to drill lateral or branch wellbores extending outwardly from the wellbore 12. Note that it is not necessary for the wellbore junctions 52, 54 to have the same number of wellbore exits 22.

As depicted in FIG. 7, a branch wellbore 62 has been drilled through one of the wellbore exits 22 of the upper wellbore junction 52. In this case, the branch wellbore 62 has been drilled by cutting an opening 68 through a sidewall of the junction 52 at a lower end of one of the legs 24 (after the inner and outer shells 56, 58 have been expanded, and after the material 34 has hardened between the inner and outer shells), and then drilling into the earth surrounding the main or parent wellbore 12. A liner or other tubular string 64 is installed in the branch wellbore 62 and secured at its upper end in the leg 24 using a liner hanger 66 or other anchoring device.

To cement the upper wellbore junction 52 in the wellbore 12 after the branch wellbore 62 is drilled, the cement 36 may be pumped through the liner string 64 into the branch wellbore, and then from the branch wellbore into the annulus 38 between the junction 52 and the wellbore 12. Alternatively, the wellbore junction 52 could be cemented in the wellbore 12 prior to drilling the branch wellbore 62, as described above.

A variety of different methods for cementing the liner string 64 in the branch wellbore 62 may be used, or the liner string could be left uncemented in the branch wellbore if desired. Screens or slotted liners may be run with the liner string 64, with or without external casing packers and/or the screens/slotted liners may be gravel packed or expanded in the branch wellbore 62. Any method of completing the branch wellbore 62 may be used in keeping with the principles of the invention.

Note that the upper wellbore junction 52 has the outwardly extending legs 24 directly opposite each other, while the lower wellbore junction 54 has the outwardly extending legs longitudinally spaced apart. Thus, it is not necessary for the wellbore junctions 52, 54 to be identical in the system 50. The wellbore junctions 52, 54 may be similar, or they may be substantially different, and they may be configured differently from they way they are depicted in FIG. 7 (e.g., having more or less wellbore exits 22, etc.), in keeping with the principles of the invention.

Figure 8:
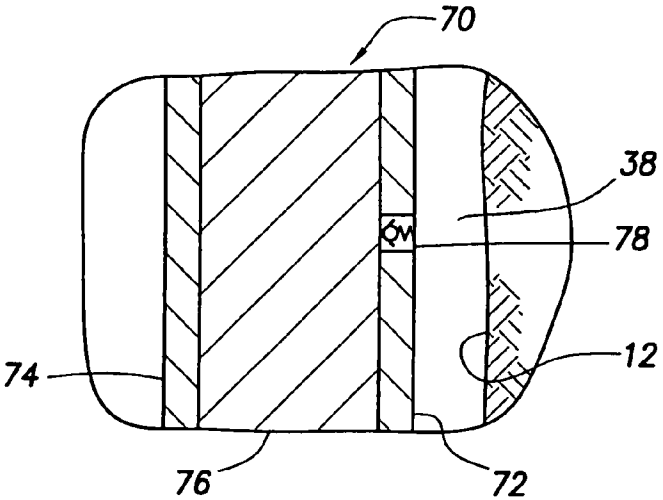
FIG. 8 is a schematic cross-sectional view of a first wellbore junction sidewall.

Referring additionally now to FIG. 8, each of the wellbore junctions 40, 52, 54 has been described above as having a sidewall 70 made up of multiple layers 72, 74, 76. FIG. 8 depicts an enlarged view of such a sidewall 70 apart from the remainder of the systems 10, 50. In the junction 40 of the system 10 described above, the outer layer 72 is the outer shell 18, the inner layer 74 is the inner shell 20, and the middle layer 76 is the material 34. In each of the junctions 52, 54 of the system 50 described above, the outer layer 72 is the outer shell 56, the inner layer 74 is the inner shell 58, and the middle layer 76 is the material 34.

The inner and outer layers 72, 74 are preferably made of metal, such as steel, aluminum, etc. However, the layers 72, 74 could be made of a composite material, such as a resin or rubber impregnated fabric. The fabric could be a woven or braided material and could be a carbon fiber fabric. The resin could be a "B-staged" resin which crosslink catalyzes when exposed to a predetermined elevated temperature downhole. A suitable composite material is described in U.S. Pat. No. 5,817,737, the entire disclosure of which is incorporated herein by this reference.

The inner and outer layers 72, 74, or either of them, could be made of a rubber material, so that they are impervious to the material 34 (layer 76) in its liquid state. For example, the layers 72, 74 could be made of a rubber coated or rubber impregnated fabric composite material. The fabric could be preformed, so that the layers 72, 74 will have the intended shapes (e.g., the inner shell 20 being Y-shaped with the legs 22 formed at its lower end, etc.) when the layers are inflated in the well.

If the inner layer 74 is made of a composite material, then it may be advantageous to provide a protective metal liner within the inner layer, in order to shield it from wear or other damage resulting from tools passing through the junction, to protect it from erosion due to fluids flowing through the junction, etc.

It is not necessary for the inner and outer layers 72, 74 to be made of the same material. For example, the inner layer 74 could be made of a metal, while the outer layer 72 could be made of a composite material, or vice versa.

The middle layer 76 is preferably used to provide load bearing support to the inner and outer layers 72, 74. Preferably, the middle layer 76 is a hardenable load bearing material which is initially in a liquid or flowable state. The material 76 is flowed or otherwise positioned between the inner and outer layers 72, 74, and then the material is hardened. For example, the middle layer 76 could be a latex cement, a hardenable polymer, an epoxy, another bonding material, a polyurethane or a polyethylene material. If the material is an epoxy, it could be a multiple part epoxy which is initially positioned between the inner and outer layers, and then the parts are mixed in the well to cause the epoxy to harden. The middle layer 76 could be a metal, such as a white metal, lead, tin, a metal matrix composition, etc.

The middle layer 76 may be positioned at any time within the outer layer 72, and may at any time be positioned between the inner and outer layers 72, 74, before or after the layers 72, 74 (or either of them) are positioned in the well, before or after the layers 72, 74 (or either of them) are expanded in the well, etc. For example, the middle layer 76 could be a foamed material which is positioned in the outer layer 72 prior to conveying the outer layer into the well.

The foamed material middle layer 76 could be shaped (preformed) prior to being positioned in the outer layer 72, and/or it could be hardened or rigidized after it is positioned downhole, after the outer layer is expanded, etc. Alternatively, the middle layer 76 could be initially unfoamed prior to being positioned in the outer layer 72, and then foamed after it is positioned in the outer layer, after it is positioned between the inner and outer layers 72, 74, after either of the inner and outer layers is expanded, etc. Thus, if the middle layer 76 is a foamed material, it may be foamed at any time.

A pressure relief valve 78 may be included in the sidewall 70 to permit the middle layer 76 material to escape from between the inner and outer layers 72, 74 to prevent excessive pressure buildup between the inner and outer layers. For example, if the middle layer 76 material is positioned between the inner and outer layers 72, 74 after expanding the outer layer but prior to expanding the inner layer, then expansion of the inner layer could possibly cause excessive pressure buildup in the middle layer, which could hinder expansion of the inner layer if not for the presence of the relief valve 78.

As depicted in FIG. 8, the relief valve 78 is installed in the outer layer 72, so that if pressure in the middle layer 76 exceeds a predetermined level, the excess pressure will be vented out to the annulus 38. Alternatively, the relief valve 78 could vent the excess pressure to another reservoir (not shown) located elsewhere in the well. The relief valve 78 could also be otherwise positioned without departing from the principles of the invention.

Figure 9:
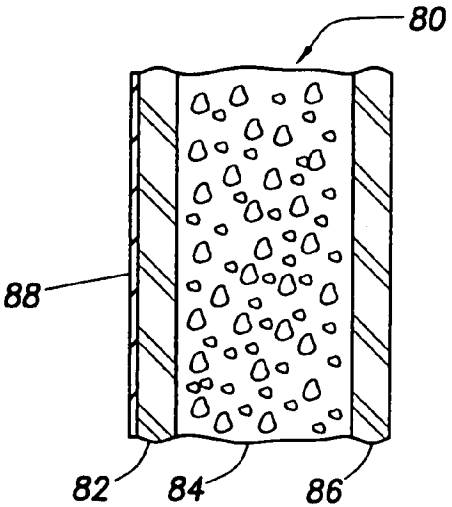
FIG. 9 is a schematic cross-sectional view of a second wellbore junction sidewall.

Referring additionally now to FIG. 9, an alternate sidewall 80 construction is representatively illustrated. The sidewall 80 includes an inner layer 82 made of a composite material, a middle layer 84 made of a foamed material, and an outer layer 86 made of a composite material. Note that it is not necessary for the inner and outer layers 82, 86 to be made of the same composite material.

A protective lining 88 is used within the inner layer 82 to protect it from wear, erosion, etc. The lining 88 is preferably made of metal, although other materials may be used if desired. The lining 88 may be installed within the inner layer 82 at any time, before or after positioning the inner layer in the well, before or after expanding the inner layer, etc. For example, the lining 88 may be positioned and expanded within the inner layer 82 after the inner layer has been expanded in the well.

Figure 10:
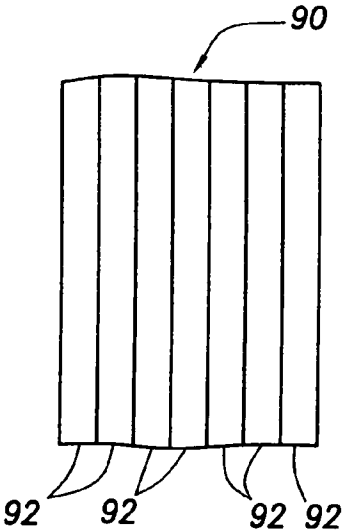
FIG. 10 is a schematic cross-sectional view of a third wellbore junction sidewall.

Referring additionally now to FIG. 10, another sidewall 90 construction is representatively illustrated. In the sidewall 90, multiple layers 92 are used, with the layers being similar to each other. For example, each of the layers 92 could be made of metal, or each of the layers could be made of a composite or other type of material.

If the layers 92 are made of metal, then the layers could be welded or otherwise attached to each other at the surface. For example, a bonding material, such as an epoxy, could be used to bond the layers 92 to each other.

However, it should be clearly understood that it is not necessary for the layers 92 to be attached to each other by bonding or welding prior to positioning the sidewall 90 in the well, or prior to expanding the sidewall in the well. For example, a bonding material could be used to bond the layers 92 to each other after the sidewall 90 is expanded in the well.

If the layers 92 are not bonded to each other prior to expanding the sidewall 90 in the well, then the layers can displace relative to each other as the layers are expanded. As a result of expanding the layers 92, residual compressive stress may be produced in an inner one of the layers, and residual tensile stress may be produced in an outer one of the layers. The layers 92 can be configured so that they are interlocked to each other after they are expanded, such as by forming interlocking profiles on the layers.

Figure 11:
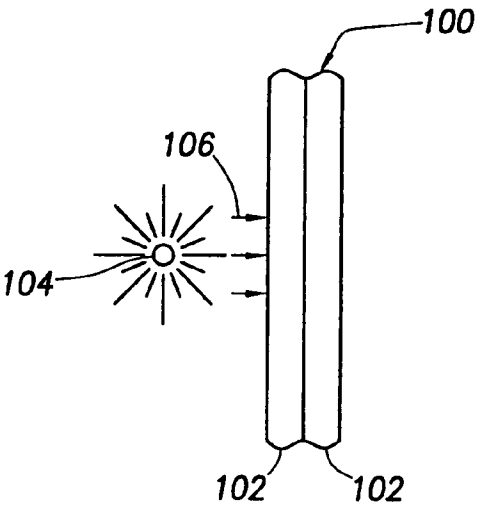
FIG. 11 is a schematic cross-sectional view of a fourth wellbore junction sidewall.

Referring additionally now to FIG. 11, another sidewall 100 construction is representatively illustrated. The sidewall 100 includes at least two metal layers 102 which are bonded to each other by detonating an explosive 104 proximate the layers. Detonation of the explosive 104 sends a shock wave 106 through the layers 102, thereby causing the layers to bond to each other.

The layers 102 could be explosively bonded to each other before or after the layers are positioned in the well. For example, one of the layers 102 could be expanded in the well, then the other layer could be expanded within the already expanded layer, and then the explosive 104 could be detonated within the inner layer to thereby bond the layers to each other. A bonding material, such as an epoxy, could be positioned between the layers 102 prior to detonating the explosive 104.

In each of the systems 10, 50 described above, the wellbore junctions 40, 52, 54 have sidewalls constructed of multiple layers. It is believed that this multi-layered sidewall construction provides improved burst and collapse resistance, improved ductility and other benefits. However, a suitable wellbore junction or other chamber could be constructed using a single layer of material, such as a composite material.

For example, the inner shell 20 of the system 10 could be expanded in the wellbore 12 without using the outer shell 18. The inner shell 20 could be made of the composite material described in the incorporated U.S. Pat. No. 5,817,737, so that after the inner shell is expanded the elevated downhole temperature would cause the composite material to harden. Additional wellbores could then be drilled extending outward from the wellbore exits 24, either before or after the expanded and hardened inner shell is cemented in the wellbore 12. Preferably, the expanded inner shell 20 would be provided with an internal protective lining, such as the metal lining 88 described above.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A subterranean well system, comprising:

a chamber expanded within the well, the chamber having a wall made up of multiple layers, the layers including an outer shell and an inner shell, wherein the inner shell is displaced at least partially into the outer shell after the outer shell is expanded in the well, the inner shell being increasingly received within the outer shell after the outer shell is expanded in the well, and wherein the layers further include a hardened load bearing material positioned between the inner and outer shells.

2. A subterranean well system, comprising:

a chamber expanded within the well, the chamber having a wall made up of multiple layers, the layers including an outer shell and an inner shell, and wherein the inner shell is expanded within the outer shell after the outer shell is expanded in the well, the inner shell being expanded within and outwardly toward the outer shell.

3. A subterranean well system, comprising:

a chamber expanded within the well, the chamber having a wall made up of multiple layers, the layers including an outer shell and an inner shell, and wherein the layers further include a hardened load bearing material positioned between the inner and outer shells.

4. The system according to claim 3, wherein the load bearing material is positioned between the inner and outer shells after the inner and outer shells are positioned in the well.

5. The system according to claim 3, wherein the load bearing material is positioned within the outer shell after the outer shell is expanded in the well.

6. The system according to claim 3, wherein the load bearing material is hardened in the well after the load bearing material is positioned between the inner and outer shells.

7. A method of forming an expanded chamber in a subterranean well, the method comprising the steps of:

positioning multiple chamber wall layers in the well, the layers including an outer shell and an inner shell; and expanding the layers in the well to form the expanded chamber, including expanding the outer shell, and expanding the inner shell within the outer shell, and wherein the layers expanding step further comprises expanding the inner shell after expanding the outer shell, such that each of the inner and outer shells extends completely about the chamber.

8. A method of forming an expanded chamber in a subterranean well, the method comprising the steps of:

positioning multiple chamber wall layers in the well, the layers including an outer shell and an inner shell;

connecting the inner shell to a tubular string; and expanding the layers in the well to form the expanded chamber, including expanding the outer shell, and expanding the inner shell within the outer shell, wherein the positioning step further comprises the step of displacing the inner shell at least partially into the outer shell after the step of expanding the outer shell, the inner shell being increasingly received within the outer shell after the outer shell is expanded in the well, and wherein the inner shell displacing step further comprises displacing the tubular string.

9. A method of forming an expanded chamber in a subterranean well, the method comprising the steps of:

positioning multiple chamber wall layers in the well, the layers including an outer shell and an inner shell;

expanding the layers in the well to form the expanded chamber, including expanding the outer shell, and expanding the inner shell within the outer shell; and hardening a load bearing material between the inner and outer shells in the well.

10. The method according to claim 9, wherein the hardening step is performed after the step of expanding the outer shell.

11. The method according to claim 10, wherein the hardening step is performed after the step of expanding the inner shell.

12. The method according to claim 11, further comprising the step of cementing the expanded chamber in a wellbore of the well after the hardening step.

13. The method according to claim 9, further comprising the step of positioning the load bearing material between the inner and outer shells.

14. The method according to claim 13, wherein the load bearing material positioning step is performed prior to positioning the inner and outer shells in the well.

15. The method according to claim 13, wherein the load bearing material positioning step is performed after positioning the inner and outer shells in the well.

16. The method according to claim 13, wherein the load bearing material positioning step is performed after expanding the outer shell in the well.

17. The method according to claim 16, wherein the load bearing material positioning step is performed prior to expanding the inner shell in the well.

18. The method according to claim 16, wherein the load bearing material positioning step is performed after expanding the inner shell in the well.

19. The method according to claim 13, wherein the step of positioning the load bearing material between the inner and outer shells is performed by positioning the load bearing material within the outer shell after expanding the outer shell in the well, and then expanding the inner shell.

20. The method according to claim 19, wherein the step of positioning the load bearing material within the outer shell is performed prior to displacing the inner shell at least partially into the outer shell.

21. The method according to claim 13, wherein the step of positioning the load bearing material between the inner and outer shells is performed by positioning the load bearing material within the outer shell prior to expanding the outer shell in the well.

22. The method according to claim 21, wherein the step of expanding the outer shell further comprises positioning additional load bearing material within the outer shell.

23. The method according to claim 13, wherein the step of positioning the load bearing material between the inner and outer shells is performed by positioning the load bearing material between the inner and outer shells after expanding the inner and outer shells in the well.

24. The method according to claim 23, further comprising the step of displacing the inner shell at least partially into the outer shell prior to expanding the inner shell.

25. A method of forming an expanded chamber in a subterranean well, the method comprising the steps of:

positioning multiple chamber wall layers in the well, the layers including an outer shell and an inner shell;

expanding the layers in the well to form the expanded chamber, including expanding the outer shell, and expanding the inner shell within the outer shell; and sealing between the expanded inner and outer shells prior to positioning a load bearing material between the inner and outer shells.

26. The method according to claim 25, wherein the sealing step further comprises forming at least first and second spaced apart seals between the expanded inner and outer shells, and wherein the load bearing material positioning step further comprises positioning the load bearing material between the first and second seals.

27. A method of forming an expanded chamber in a subterranean well, the method comprising the steps of:

positioning multiple chamber wall layers in the well;

expanding the layers in the well to form the expanded chamber;

positioning a load bearing material between at least two of the layers; and then hardening the load bearing material in the well, and wherein the load bearing material positioning step is performed after positioning the layers in the well.

28. A method of forming an expanded chamber in a subterranean well, the method comprising the steps of:

positioning multiple chamber wall layers in the well;

expanding the layers in the well to form the expanded chamber;

positioning a load bearing material between at least two of the layers; and then hardening the load bearing material in the well, and wherein the load bearing material positioning step is performed after at least one of the layers is expanded in the well.

29. A method of forming an expanded chamber in a subterranean well, the method comprising the steps of:

positioning multiple chamber wall layers in the well;

expanding the layers in the well to form the expanded chamber;

positioning a load bearing material between at least two of the layers; and then hardening the load bearing material in the well, and wherein the load bearing material positioning step is performed while at least one of the layers is expanded in the well.

30. A method of forming an expanded chamber in a subterranean well, the method comprising the steps of:

positioning multiple chamber wall layers in the well;

expanding the layers in the well to form the expanded chamber;

forming a wellbore exit in an inner one of the layers;

cutting an opening through the chamber wall at the wellbore exit after the expanding step; and flowing cement outward through the opening and into an annulus formed between the expanded chamber and a first wellbore of the well.

31. The method according to claim 30, further comprising the steps of:

drilling a second wellbore outward from the opening; and securing a tubular string in the wellbore exit, the tubular string extending into the second wellbore.

32. The method according to claim 31, wherein the flowing step further comprises flowing the cement through the tubular string and into the second wellbore.

33. A method of forming an expanded chambers in a subterranean well, the method comprising the steps of:

positioning multiple sets of chamber wall layers in the well;

expanding each of the sets of chamber wall layers in the well to thereby form the multiple expanded chambers in the well;

connecting an annular barrier between each adjacent pair of the multiple sets of the chamber wall layers; and setting each annular barrier to thereby seal between the multiple sets of the chamber wall layers and a wellbore of the well.

34. The method according to claim 9, further comprising the step of providing the layers including a load bearing material positioned between at least two of the layers.

35. The method according to claim 34, wherein in the providing step, the load bearing material includes a hardenable polymer material.

36. The method according to claim 34, wherein in the providing step, the load bearing material includes a hardenable latex cement.

37. The method according to claim 34, wherein in the providing step, the load bearing material includes a hardenable polyurethane material.

38. The method according to claim 34, wherein in the providing step, the load bearing material includes a hardenable polyethylene material.

39. The method according to claim 34, wherein in the providing step, the load bearing material includes a hardenable metal matrix composition.

40. The method according to claim 34, wherein in the providing step, the load bearing material includes a hardenable bonding material.

41. The method according to claim 34, wherein in the providing step, the load bearing material includes a foamed material.

42. The method according to claim 34, wherein the at least two layers are each made of a metal material.

43. The method according to claim 34, wherein the at least two layers are each made of a composite material.

44. The method according to claim 34, wherein in the providing step, the load bearing material includes a hardenable epoxy material.

45. The method according to claim 44, wherein the epoxy material includes at least two parts, and further comprising the step of mixing the two parts in the well to harden the epoxy material.

46. A method of forming an expanded chamber in a subterranean well, the method comprising the steps of:

positioning multiple chamber wall layers in the well;

providing the layers including a load bearing material positioned between at least two of the layers, the load bearing material including a foamed material;

expanding the layers in the well to form the expanded chamber; and foaming and hardening the foamed material after the expanding step.

47. A method of forming an expanded chamber in a subterranean well, the method comprising the steps of:

positioning multiple chamber wall layers in the well;

providing the layers including a load bearing material positioned between at least two of the layers, the load bearing material including a foamed material;

expanding the layers in the well to form the expanded chamber; and foaming and hardening the foamed material prior to the positioning step.

48. A method of forming an expanded chamber in a subterranean well, the method comprising the steps of:

positioning multiple chamber wall layers in the well;

forming at least one of the layers of a composite material, the forming step including the step of impregnating a fabric material with a resin to form the composite material; and expanding the layers in the well to form the expanded chamber.

49. The method according to claim 48, wherein in the forming step, the fabric is a carbon fiber cloth.

50. The method according to claim 48, wherein in the forming step, the fabric is a woven material.

51. The method according to claim 48, wherein in the forming step, the fabric is a braided material.

52. The method according to claim 48, further comprising the step of crosslink catalyzing the resin in the well.

53. The method according to claim 52, wherein the crosslink catalyzing step is performed in response to heating the resin to a predetermined temperature in the well.

54. A method of forming an expanded chamber in a subterranean well, the method comprising the steps of:

positioning multiple chamber wall layers in the well;

forming at least two of the layers of a composite material;

expanding the layers in the well to form the expanded chamber; and positioning a foamed material between the composite layers.

55. A method of forming an expanded chamber in a subterranean well, the method comprising the steps of:

positioning multiple chamber wall layers in the well;

forming at least one of the layers of a rubber material, the forming step including the step of impregnating a fabric with the rubber material; and expanding the layers in the well to form the expanded chamber.

56. A method of forming an expanded chamber in a subterranean well, the method comprising the steps of:

positioning multiple chamber wall layers in the well;

forming at least one of the layers of a rubber material, the forming step including the step of coating a fabric with the rubber material; and expanding the layers in the well to form the expanded chamber.

* * * * *